United States Patent [19]

Wang et al.

[11] Patent Number: 5,008,975

[45] Date of Patent: Apr. 23, 1991

[54] HINGE DEVICE

[76] Inventors: Rong W. Wang; Johnson S. Chang, both of 9F-1, No. 197, Sec. 4, Nan King E. Rd., Taipei, Taiwan

[21] Appl. No.: 535,064

[22] Filed: Jun. 8, 1990

[51] Int. Cl.[5] ..... E05D 7/10

[52] U.S. Cl. ..... 16/266; 16/386; 16/254; 16/260

[58] Field of Search ..... 16/266, 376, 386, 357, 16/289, 292

[56] References Cited

U.S. PATENT DOCUMENTS

| | | | |
|---|---|---|---|
| 443,380 | 12/1890 | Rieckert | 16/292 |
| 448,301 | 3/1891 | Oliver | 16/266 |
| 3,394,428 | 7/1968 | Peterson | 16/357 |
| 3,610,460 | 10/1971 | Siklos et al. | 16/266 X |
| 3,662,429 | 5/1972 | Johnson et al. | 16/357 |
| 4,677,707 | 7/1987 | Holler | 16/386 X |

FOREIGN PATENT DOCUMENTS

| | | | |
|---|---|---|---|
| 0963480 | 7/1964 | United Kingdom | 16/266 |

*Primary Examiner*—Richard K. Seidel
*Assistant Examiner*—Patty E. Hong
*Attorney, Agent, or Firm*—Bacon & Thomas

[57] ABSTRACT

A hinge for mounting a door to a door frame through upper and lower assemblies, with each assembly including a door frame plate and a door plate disposable in engagement with each other to define a common pivot axis extending through both assemblies. The door frame plate of the upper assembly is provided with a hole engageable by an axle carried on the top surface of the corresponding door plate. The door plate of the second assembly includes a downwardly extending flange engageable within a blind hole formed in the corresponding door frame plate, with the bottom of the hole having a convex protrusion for stabilizing the door in an open position.

2 Claims, 6 Drawing Sheets

HINGE DEVICE

BACKGROUND OF THE INVENTION

The present invention relates generally to a hinge device for mounting doors to doorframes, and more particulary, to an improved hinge device which is easily mounted and dismounted.

A conventional hinge substantially comprises two fixing leaves and a revolving shaft. An open door exposes the entire hinge device to dust and other pollutants in the atmosphere which adhere to the hinge causing deterioration. Moreover, the revolving shaft is often lubricated to allow the door to swing smoothly about the hinge so that decay causing pollutants readily adhere to the lubricant.

Furthermore, since coventional hinges produced by a metal stamping process support the weight of the door on the revolving shaft only, the tangential force of weight of the door frequently causes the revolving shaft to loosen or become deformed so that the door does not swing freely about the hinge or does not close tightly. Now that metal and glass doors are becoming more widely used, hinges which can support heavier doors are required.

An improved hinge device should also be more easily detached from a door than a conventional hinge which is fixed by means of bolts or screws.

SUMMARY OF THE INVENTION

Accordingly, it is an object of this invention to provide an improved hinge device for doors.

A further object of this invention is to provide a novel hinge device, which is easily mounted on a door and detached from a door.

Another object of this invention is to provide a novel hinge device which can support heavier doors.

Further objectives and advantages of the present invention will become apparent as the following description proceeds, and the features of novelty which characterize the invention will be pointed out with particularity in the claims annexed to and forming a part of this invention.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
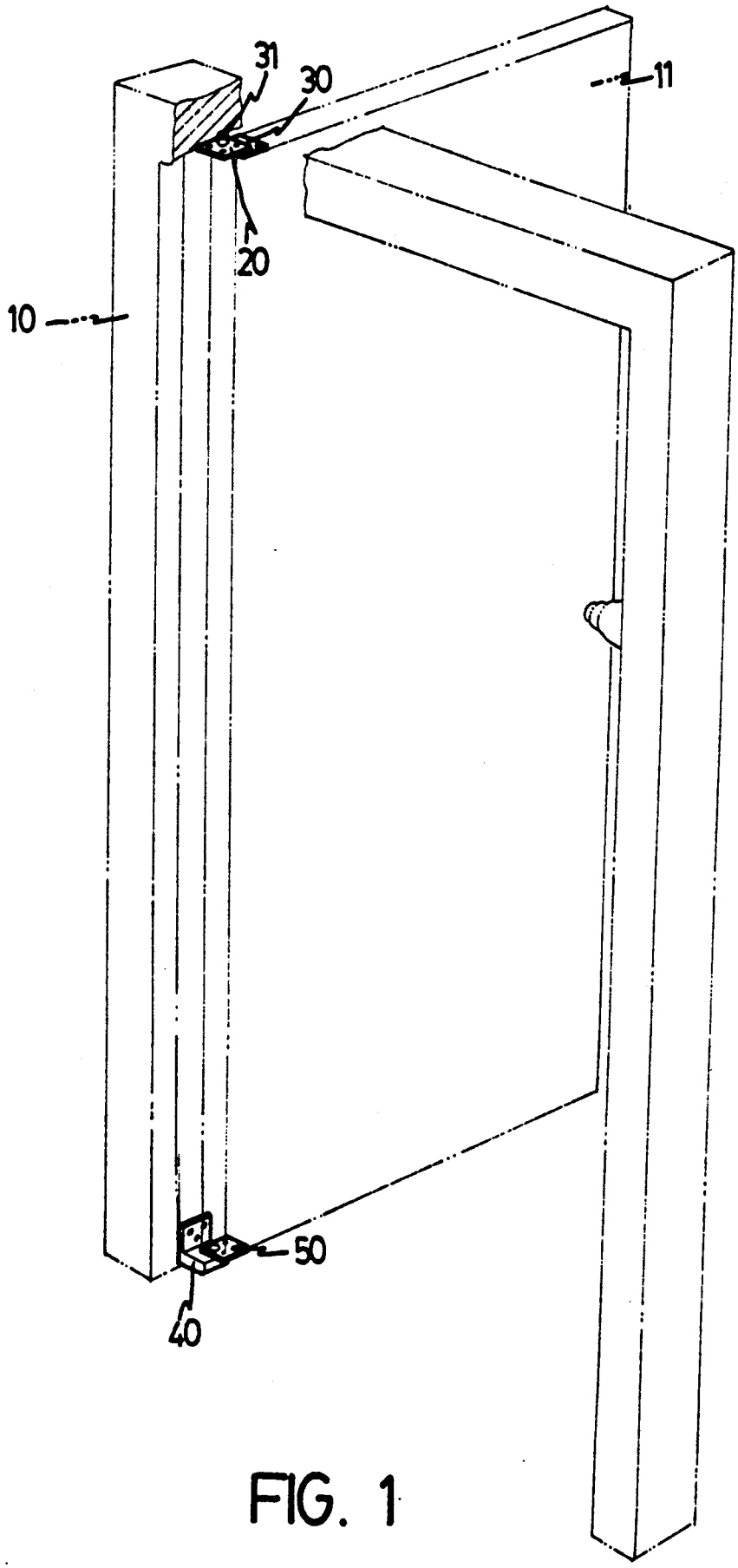
FIG. 1 is a perspective view of a hinge device fixedly secured to the door and the doorframe in accordance with the present invention.

With reference to the drawings and initially FIG. 1, the present invention relates to a hinge device for mounting doors to doorframes and more particularly, to an improved hinge device which is easily mounted and detached.

Figure 2:
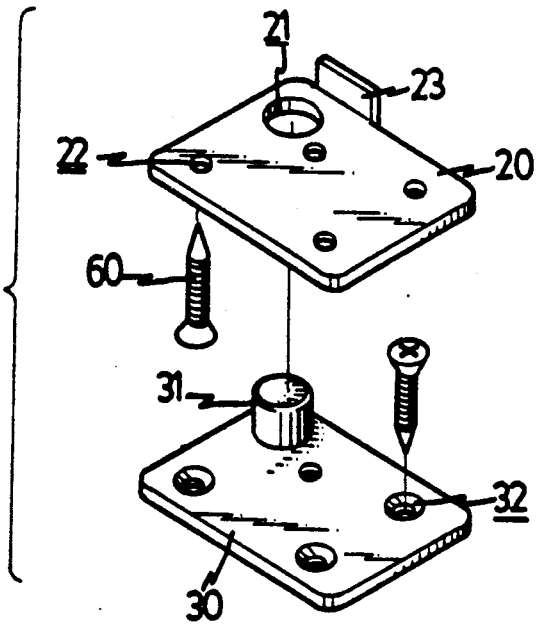
FIG. 2 is an exploded perspective view of a first assembly, which comprises an upper doorframe plate and an upper door plate.
Figure 3:
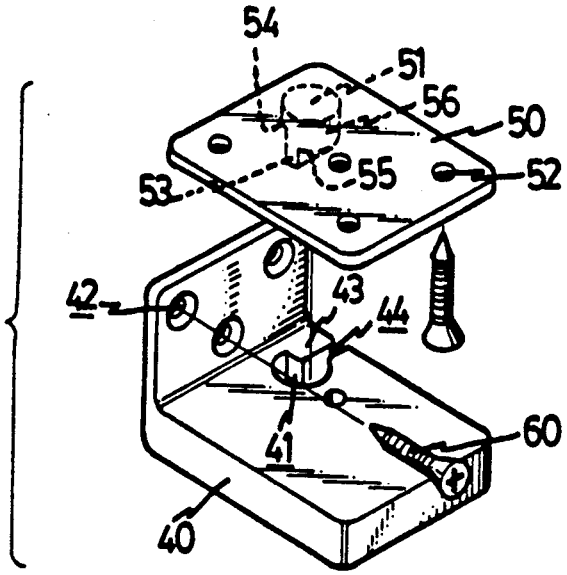
FIG. 3 is an exploded perspective view of a second assembly, which comprises a lower door plate and a lower doorframe plate.

FIG. 2 and FIG. 3 shows that the present hinge device comprises a first assembly and a second assembly. The first assembly consists of an upper doorframe plate 20 and an upper door plate 30. The upper doorframe plate 20 has an axle hole 21 on a corner and screwing holes 22 effectively are arranged thereon. A stop plate 23 extends outwardly from a side edge of the upper doorframe plate 20. The upper door plate 30 has an axle 31 vertically protruding from a top surface and screwing holes 32 effectively arranged thereon. The axle 31 of the upper door plate 30 engages into the axle hole 21 of the upper doorframe plate 20 so that the upper door plate 30 pivots about its axle 31 with respect to the upper doorframe plate 20. The number of screwing holes 22 on the upper doorframe plate 20 and the upper door plate 30 are sufficiently arranged so that the upper doorframe plate 20 and the upper door plate 30 are respectively fixed to the upper doorframe and the top surface of the door with needed screws 60.

The second assembly consists a lower door plate 50 and a lower doorframe plate 40. The lower door plate 50 has a protrusion axle 51 vertically protruding from a bottom surface of the lower door plate 50. The protrusion axle 51 comprises a shaft 56, a first recess 54, a second recess 55, and a flange 53. The first recess 54 is deeper than the second recess 55. The lower doorframe plate 40 consists an alley 44 leading to a notched blind hole 41 and a wedge 43. The flange 53 of the lower door plate 50 is passable through the alley 44 of the lower doorframe plate 40 and the notched blind hole 41 accommodates just the protrusion axle 51 of the lower door plate 50. The lower door plate 50 is revolvable within the notched blind hole 41. The shaft 56 and the flange 53 of the lower door plate 50 bear respectively against the wedge 43 and the bottom of the notched blind hole 41 of the lower doorframe plate 40. Screwing holes 42 are effectively arranged on the lower door plate 50 and the lower doorframe plate 40 so that the lower doorframe plate 40 and the lower door plate 50 are respectively fixed to the lower doorframe and the bottom surface of the door with needed screws 60. The lower doorframe plate 40 can be produced in a L-shape so that the lower doorframe 40 can be fixed either on side doorframes or bottom doorframes.

Referring to FIG. 1, the upper doorframe plate 20 and the lower doorframe plate 40 are fixed to the corners of the upper and lower portion of the doorframe 10. The upper door plate 30 and the lower door plate 50 are fixed to the top surface and the bottom surface of door 11 and then door 11 is mounted to the doorframe 10.

Figure 4:
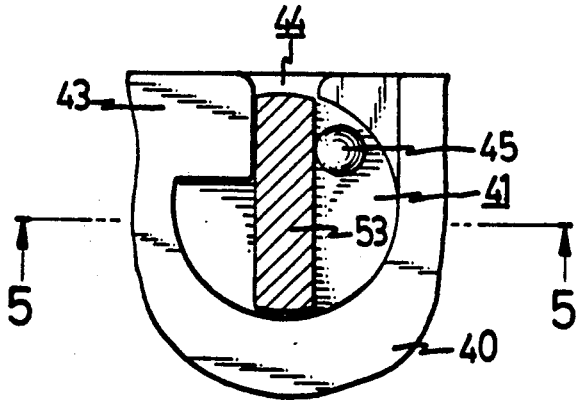
FIG. 4 is a top plane cross sectional view of the second assembly with the door opened.

FIG. 4 shows a top plane sectional view of the lower doorframe plate 40, wherein the flange 53 has passed the alley 44 and the door 11 is opened. A convex protrusion 45 with a smooth surface extends from the bottom of the notched blind hole 41 and the distance between the outer edge of the convex protrusion 45 and the wedge 43 is just equal to the width of the flange 53. Thus, when the flange 53 is between the wedge 43 and the convex protrusion 45, i.e., the door 11 will be stable in an open position.

Figure 5:
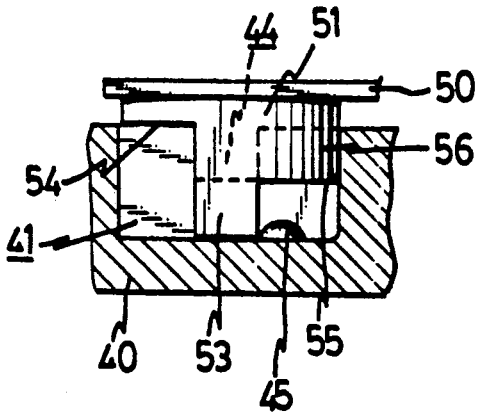
FIG. 5 is a side cross sectional view along line 3—3 of FIG. 4 with the door opened.

FIG. 5 shows a side cross sectional view along line 5—5 of FIG. 4, wherein the shaft 56 and the flange 53 of the lower door plate 50 bear respectively against the wedge 43 and the bottom of the notched blind hole 41 of the lower doorframe plate 40. Since the outer surface of the shaft 56 is smooth, the rotation of the protrusion axle 51 will be facile within said notched blind hole 41, i.e., the door can be opened and closed easily.

Figure 6:
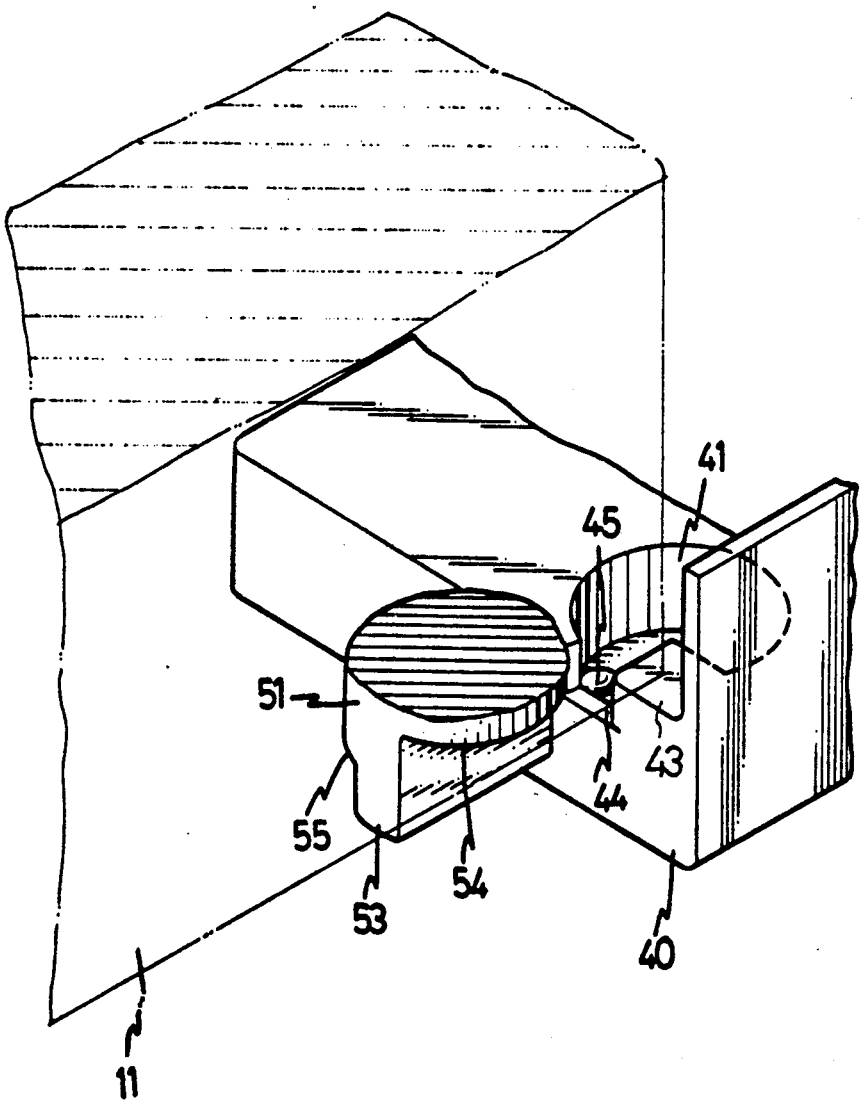
FIG. 6 is a perspective view of the second assembly in which the lower door plate acts in conjunction with the lower doorframe plate, wherein the protrusion axle of the lower door plate will mount to the lower doorframe plate.
Figure 7:
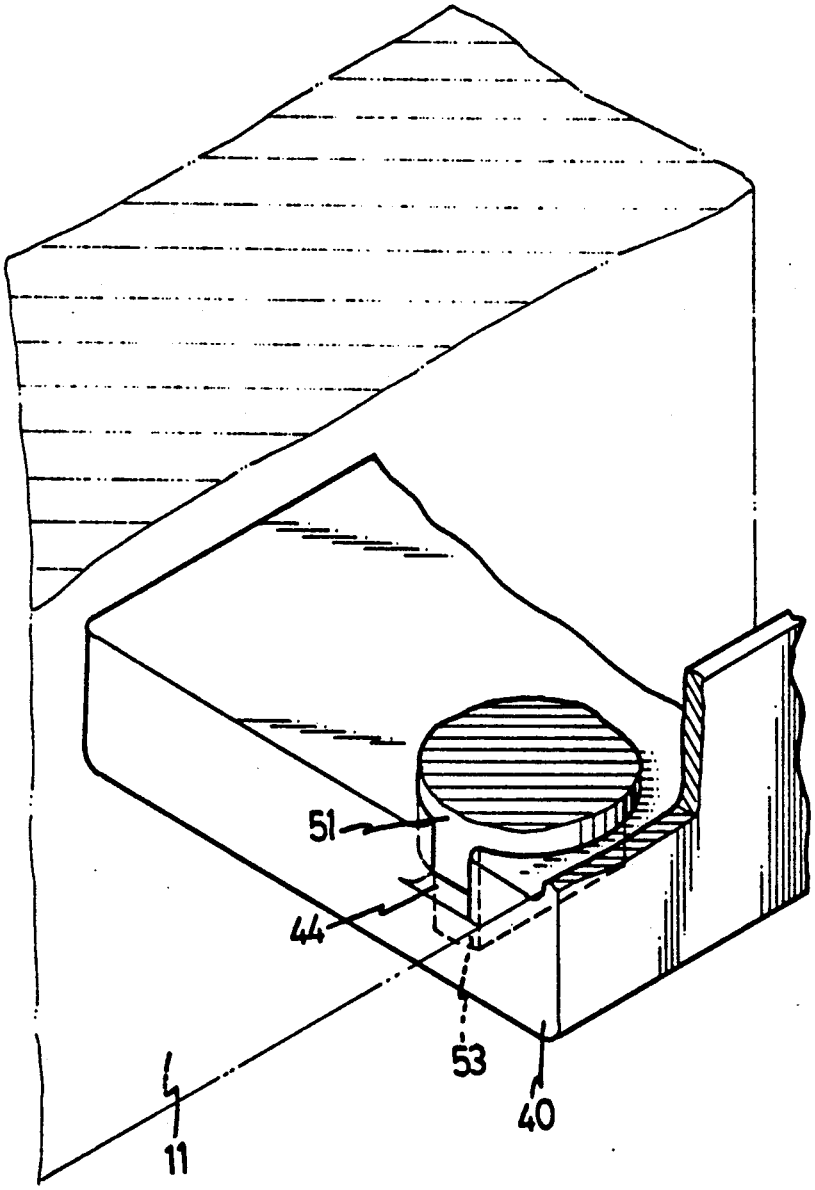
FIG. 7 is a perspective view of the second assembly, wherein the lower door plate acts in conjunction with the lower doorframe plate, wherein the protrusion axle is mounted to the lower doorframe plate.
Figure 8:
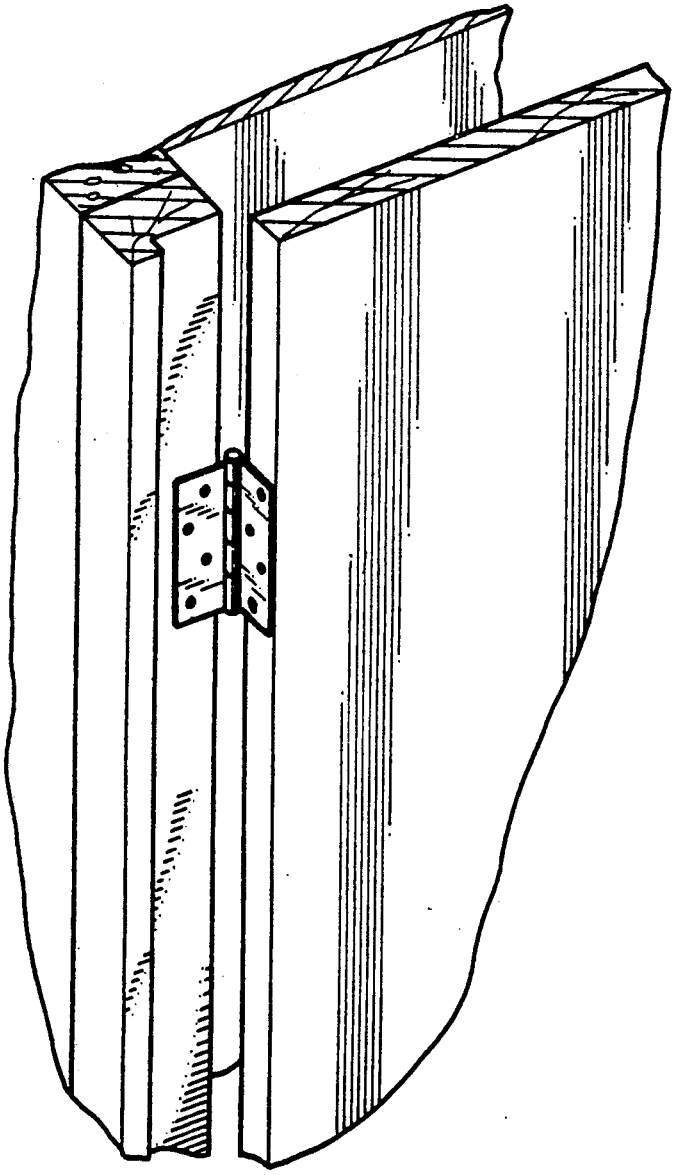
FIG. 8 PRIOR ART
FIG. 8 is a perspective view of a conventional hinge.

With reference to FIG. 6, the protrusion axle 51 will mount to the lower doorframe plate 40. FIG. 7 shows the protrusion axle 51 mounted to the lower doorframe plate 40. During assembly, the upper doorframe plate 20 and the lower doorframe plate 40 are fixed to the upper and lower corners of doorframe 10, and the upper door plate 30 and the lower door plate 50 are fixed with respect to the upper doorframe plate 20 and the lower doorframe plate 40 onto the top and bottom surfaces of door 11, then the door 11 is erected perpendicularly to doorframe 10. Following, the axle 31 of the upper door plate 30 and the flange 53 of the lower door plate 50 are aligned respectively with the axle hole 21 of the upper doorframe plate 20 and the alley 44 of the lower doorframe plate 40. The axle 31 is engaged into the axle hole 21 and the flange 53 is pushed into the notched blind hole 41 by means of the alley 44 of the lower doorframe plate 40. Because of the depth difference between the first recess 54 and the second recess 55, after the flange 53 has passed through the alley 44, the door 11 will drop a little and the protrusion axle 51 will be confined within the notched blind hole 41 of the lower doorframe plate 40.

The notched blind hole 41 may be further displaced with the convex protrusion 45 so when the door 11 is opened or closed, the door 11 will be kept stable because of the small resistance created by the convex protrusion 45 of the lower doorframe plate 40.

The present hinge device comprises the first and second assemblies which are consist of separate pieces that need not be fastened to each other. Therefore, a single craftsman can assemble these separate pieces sequentially whereas the conventional hinge must be assembled by a coordination of several craftsman.

While the present invention has been explained in relation to its preferred embodiment, it is to be understood that various modifications thereof will be apparent to those skilled in the art upon reading this specification. Therefore, it is to be understood that the invention disclosed herein is intended to cover all such modification that will fall within the scope of the appended claims.

I claim:

1. A hinge device for mounting a door to a door frame comprising:

(a) a first assembly including an upper door frame plate for attachment to a door frame and an upper door plate for attachment to a top surface of a door, the upper door frame plate having an axle hole formed in a corner thereof, the upper door plate having an axle extending outwardly from a top surface thereof, the axle being engageable within the axle hole to define an axis about which the upper door plate pivots relative to the upper door frame plate; and (b) a second assembly including a lower door frame plate for attachment to the door frame and a lower door plate for attachment to a bottom surface of the door, the lower door plate having a protrusion axle extending outwardly from a bottom surface thereof, the protrusion axle being defined by a shaft, first and second recesses, a flange positioned between the recesses, and the first recess being deeper than the second recess, the lower door frame plate having a third recess formed therein, the third recess being defined by a notched blind hole, an alley extending from the blind hole, a wedge, and a convex protrusion extending outwardly from a bottom surface of the blind hole, the flange of the lower door plate being disposable within the alley and blind hole to position the shaft within the blind hole and define a pivot axis therewith, and the flange being disposable between the wedge and the convex protrusion for stabilizing the door in an open position.

2. The hinge device of claim 1 further including a stop plate extending from an edge of the upper door frame plate.

* * * * *